US010209005B2

(12) United States Patent
Chen et al.

(10) Patent No.: US 10,209,005 B2
(45) Date of Patent: Feb. 19, 2019

(54) UV LED SYSTEMS AND METHODS

(71) Applicant: Sunlite Science & Technology, Inc., Lawrence, KS (US)

(72) Inventors: Jeff Chen, Lawrence, KS (US); Xiaofang Suo, Lawrence, KS (US)

(73) Assignee: Sunlite Science & Technology, Inc., Lawrence, KS (US)

( * ) Notice: Subject to any disclaimer, the term of this patent is extended or adjusted under 35 U.S.C. 154(b) by 301 days.

(21) Appl. No.: 15/281,303

(22) Filed: Sep. 30, 2016

(65) Prior Publication Data

US 2017/0097150 A1 Apr. 6, 2017

Related U.S. Application Data

(60) Provisional application No. 62/237,152, filed on Oct. 5, 2015.

(51) Int. Cl.
*F26B 3/28* (2006.01)
*B05D 3/06* (2006.01)

(52) U.S. Cl.
CPC ..... *F26B 3/28* (2013.01); *B05D 3/067* (2013.01)

(58) Field of Classification Search
CPC . F26B 3/28; B05D 3/067; F21V 29/00; F21V 7/06
USPC ..... 34/275, 90, 210–218; 362/218
See application file for complete search history.

(56) References Cited

U.S. PATENT DOCUMENTS 1,420,679 A * 6/1922 Beckworth ..... F26B 3/00 34/195
3,448,526 A * 6/1969 Smith, Jr. ..... B41F 23/0426 34/267
4,205,223 A 5/1980 Cole
4,357,648 A 11/1982 Nelson
4,495,550 A 1/1985 Visciano
4,701,835 A 10/1987 Campagnuolo et al.
4,823,242 A 4/1989 Maglica et al.
5,043,854 A 8/1991 Gammache
(Continued)

FOREIGN PATENT DOCUMENTS

EP 3047971 A1 * 7/2016 ..... B41F 23/0409
JP 200964781 A 3/2009

OTHER PUBLICATIONS

PCT Application No. PCT/US2014/014664 International Search Report and Written Opinion dated May 28, 2014.

*Primary Examiner* — Stephen M Gravini
(74) *Attorney, Agent, or Firm* — Erise IP, P.A.

(57) ABSTRACT

Ultra violet light-emitting diode (hereafter UV LED) curing units containing one or X array or XY arrays of UV LED modules with integrated optical, mechanical, and heat dissipation systems, and one, or X array, or XY arrays of extrusions with integrated air or liquid cooling systems to receive and house the integrated UV LED. The UV LED modules may be any size or shape depending on the power requirements of a given curing application. The LED chips or the groups of LED chips used for the above UV LED modules may be in other wavelengths for other applications. The UV LED modules have excellent heat dissipation because the LED chips or groups of LED chips are directly mounted on metal extrusion. The LED modules also have a single optical lens system between the LED chips and the surrounding ambient air.

7 Claims, 11 Drawing Sheets

(56) References Cited

U.S. PATENT DOCUMENTS 5,150,533 A * 9/1992 Farling ..... F26B 3/00 34/62
5,343,629 A 9/1994 Rae
5,459,944 A * 10/1995 Tatsutani ..... A47K 10/48 34/202
5,588,739 A 12/1996 Nakao
5,632,551 A 5/1997 Roney et al.
6,199,997 B1 3/2001 Outsen et al.
6,305,818 B1 10/2001 Lebens et al.
6,402,339 B1 6/2002 Mukogawa et al.
RE38,014 E 3/2003 Bieberstein
6,652,117 B2 11/2003 Tsai
6,737,811 B2 5/2004 Zhang et al.
6,802,622 B2 10/2004 Hsien
7,071,493 B2 7/2006 Owen et al.
7,488,919 B2 * 2/2009 Gagas ..... F24C 7/087 219/400
7,618,155 B2 11/2009 Chen
8,044,412 B2 10/2011 Murphy et al.
8,157,420 B2 4/2012 Song et al.
8,157,422 B2 4/2012 Paik et al.
8,220,970 B1 7/2012 Khazi et al.
8,362,677 B1 1/2013 Morejon et al.
87,774,561 7/2014 Martinez
9,303,928 B2 * 4/2016 Yang ..... A47J 36/02
2003/0151915 A1 8/2003 Mele
2004/0130894 A1 7/2004 Galli
2005/0088843 A1 4/2005 Chapman
2005/0157492 A1 7/2005 Chiu
2006/0092629 A1 5/2006 Chen
2006/0145180 A1 7/2006 Galli
2007/0115335 A1 * 5/2007 Vosahlo ..... B41J 11/002 347/102
2008/0068839 A1 3/2008 Matheson
2008/0143806 A1 * 6/2008 Claeys ..... B41F 23/0409 347/102
2008/0274641 A1 11/2008 Weber et al.
2009/0003009 A1 1/2009 Tessnow et al.
2009/0009997 A1 1/2009 Sanfilippo et al.
2010/0053950 A1 3/2010 Higuchi et al.
2010/0061108 A1 3/2010 Zhang et al.
2010/0072921 A1 3/2010 Weatherley
2010/0103666 A1 4/2010 Chang et al.
2010/0165620 A1 7/2010 Marson
2010/0259919 A1 10/2010 Khazi et al.
2011/0116262 A1 5/2011 Marson
2011/0128680 A1 6/2011 Martinez et al.
2011/0133622 A1 6/2011 Mo et al.
2011/0310599 A1 12/2011 Eberhardt
2012/0033431 A1 2/2012 Martinez et al.
2012/0069545 A1 3/2012 Choi et al.
2012/0106176 A1 5/2012 Lopez et al.
2012/0162976 A1 6/2012 Claeys
2013/0003346 A1 1/2013 Letoquin et al.
2014/0014857 A1 1/2014 Martinez et al.
2014/0111942 A1 * 4/2014 Dunn ..... G02F 1/133382 361/697
2014/0131755 A1 5/2014 Owen et al.
2014/0292970 A1 10/2014 Rae et al.
2014/0376221 A1 * 12/2014 Eliason ..... F21V 5/04 362/235
2015/0000877 A1 * 1/2015 Yang ..... F21V 29/77 165/104.31
2015/0072069 A1 3/2015 Callaghan
2016/0018096 A1 * 1/2016 Chien ..... F21V 25/12 362/373
2017/0016856 A1 * 1/2017 Zhang ..... G01N 1/02
2017/0097150 A1 * 4/2017 Chen ..... B05D 3/067

* cited by examiner

UV LED SYSTEMS AND METHODS

RELATED APPLICATIONS

This application claim priority to U.S. Provisional Patent Application 62/237,152, filed Oct. 5, 2015, the disclosure of which is incorporated herein by reference.

TECHNICAL FIELD

This invention relates to the general field of curing with LED chips. More specifically, this invention relates to using thermally efficient ultra-violet (UV) light emitting diode (LED) modules emitting in the range of 350 to 405 for various applications.

BACKGROUND OF THE INVENTION

UV wavelength lighting has a wide variety of applications including the curing of inks, coatings, sealants, and adhesives. Curing with UV LED lighting is becoming increasingly popular as an alternative to curing with conventional UV mercury lamps because of its higher energy efficiency, concentrated power output, longer operating lifetime, lower heat generation, and environmental friendliness. (LED lighting contains no mercury and doesn't produce ozone). Curing with UV lighting is generally done with some form of curing unit; the main components of a UV LED curing unit include UV LED modules and a cooling system for heat removal.

It is known that prior UV LED curing units can comprise one or more LED array modules mounted on one or more heat sinks, optical systems, e.g., reflectors and lenses, and a unit enclosure. The LED array modules contain arrays of universal LED packages that need to be protected, or further focused to achieve the desired intensity for the curing application through secondary lenses and reflectors. Reflectors may be integrated with the LED array modules. Secondary lenses are necessary with these conventional systems. Because of this, the airgap between the primary lens and the secondary lens, reduces the UV energy output efficiency and produce more heat. In addition, an enclosure for the curing unit is necessary to hold the reflector and the secondary lenses. Such heat sinks may use thermally-dissipating fins, or chambers formed by adjacent plates that allows a cooling liquid (or air) to pass through for removal of heat. Versions also use multiple micro channels formed by a stack of plates that allow liquid or air to pass through. Conventionally, heat sinks have been housed within the curing unit, or within a separate enclosure.

It is also known that prior UV LED curing units may comprise: an LED assembly with multiple large chips mounted with insulating resin (barriers to heat) on a conductive plate, then on a heat sink that includes or comprises a water rail with channels, optical systems such as a reflector and lens, end caps to form a fluidic circuit in the water rail, end caps with connectors, a separate enclosure for the heat sink, reflector and LED assembly. Reflectors and the lenses for the curing unit are not integrated with the LED assembly with these conventional systems.

The above LED array modules/assemblies are known to comprise LED chips mounted on either Metal Core Printed Circuit Board (hereafter MCPCB), ceramic, or silicon. Mounting chips on MCPCB generally creates multiple additional insulating layers that act as heat barriers. In these arrangements, ceramic itself is the insulating layer. Silicon, when used, has superior heat dissipation than exists with some other methods, but still introduces an extra insulating layer to the system.

SUMMARY OF THE INVENTION

One goal of this invention is to eliminate any possible heat insulating layers by integrating optical and heat dissipation systems into the UV LED module. Another goal of this invention is to couple the heat dissipation system of the UV LED module to a unit enclosure that also integrates a heat dissipation system. The UV LED modules are preferably arranged in a way that it is in close proximity to a cooling means to allow for maximum heat transfer. The integration maximizes heat transfer and simplifies the manufacturing. The integration and heat dissipation system design ensure the best energy output efficiency and optimized intensity and light coverage.

In one aspect, a UV curing unit is described including multiple extruded aluminum housings and UV LED modules installed onto the extruded aluminum housing. The cover that may include air intake holes and circulating fans. The extruded aluminum housings may be one single housing, an X array wherein the said housings are arranged in a single row, or comprise XY arrays wherein the said housings are arranged in multiple rows. The aluminum housings may be constructed of metals, alloys or materials possessing high heat conductivity.

Each individual UV LED module may be rectangular or round, and include one or more LED chips directly mounted onto a heat sink having integrated reflectors, contact pins for wires to couple thereto, and an optical lens which is also the final lens of the curing unit. The aluminum housing is, in embodiments, extruded and may include integrated air circulation slots, flutes, or fins in order to maximize heat transfer and air circulation. The said aluminum housing may be cylindrical or shaped as a rectangular block. The said X array or XY arrays is formed by using rows of "U" metal channels to hold rows of said metal housings.

In another aspect, a UV curing unit uses a single piece metal extrusion with a face plate. This enables the receipt of multiple UV LED modules. The metal extrusion has: (i) one or more cooling channels to accommodate air or liquid that acts as a coolant, (ii) one or more channels for running wires for electrical connections, (iii) a channel to house temperature sensor(s), and/or (iv) flutes and/or fins to maximize heat transfer.

In embodiments, UV LED modules may be one single module, an X array wherein the UV LED modules are aligned in a singles row, or XY arrays where in the UV LED modules are aligned in multiple rows.

In embodiments, each LED module includes groups of LED chips directly mounted on silvered plate copper heat sink, one optical lens for each group of LED chips, and contact pads for wires from each group to couple thereto. The said groups of LED chips may be one single group, comprise an X array wherein groups of LED chips are aligned in a single row, or comprise XY arrays wherein groups of LED chips are aligned in multiple rows. The silver plated copper heat sink may, in alternative embodiments, be other metals, alloys or other materials possessing high heat conductivity. Also, arrangements may include other plating that possesses good reflectivity.

In embodiments, the optical lenses are optical lenses wherein no secondary lens is needed.

Additionally, the cooling channels may or may not be interconnected internally.

In yet another aspect, a UV curing unit may comprise a single piece metal extrusion having one or more openings to receive one or more blowing fans, a face plate to receive multiple UV LED modules on one side, and fins on the other side to form channels for blow-in air to take heat away, one or more channels for running wires for electrical connections and to house temperature sensor(s), and with flutes and additional fins to maximize heat transfer. Like with the other versions, these air-cooled UV LED modules may comprise: (i) one single module, (ii) an X array wherein the UV LED modules are aligned in a single row, or (iii) XY arrays wherein the UV LED modules are aligned in multiple rows. Each said LED module, in embodiments, includes groups of LED chips directly mounted on silvered plate copper heat sink. In embodiments, one optical lens is provided for each group of LED chips, and contact pads for wires are provided for electrical coupling.

Again here, a silver plated copper heat sink is used. Alternatively, however, other metals, alloys or materials possessing high heat conductivity could be used to construct the heat sink. Further, other plating that possesses good reflectivity could be used. The optical lenses are preferably optical lenses with no secondary lens needed. The said cooling channels may or may not be interconnected internally.

The following descriptions are meant to summarize the invention of UV-LED curing units that are cooled either by use of an ambient air, or fan cooling system, or through the use of heat pipe, or through the use of a cooling channel using compressed air, liquid coolant, or gas. The descriptions are intended to be general in nature and only cover the basic principles of the invention. The reader should naturally appreciate that the invention's design is not limited in scope, and any aspect of the invention as described could be reasonably modified in order to accommodate desired changes in design or variations in the invention's required application.

DETAILED DESCRIPTION

Figure 1:
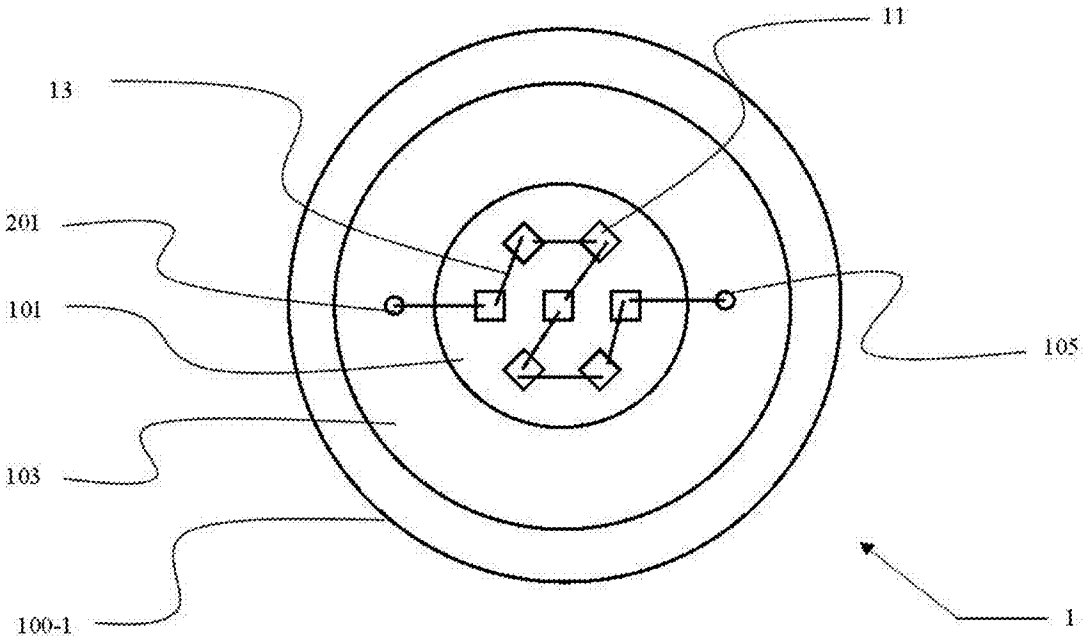
FIG. 1 is an exemplary top view layout of a round shaped UV LED module, including a plurality of LED chips, in one embodiment.

The use of MCPCB, ceramic, or silicon in prior UV LED array modules or UV LED assembly reduce the thermal performance and the light output. In addition, the secondary optical systems such as the secondary reflector and the secondary lens of the prior unit further reduce the light output. It should be recognized that although the embodiments disclosed herein are adapted for the use of UV-LED arrangements, the invention should not be, unless specifically claimed, be limited to any particular kind of LED. Those skilled in the art will recognize that, although the systems described may be especially beneficial when used in UV LED curing applications, the systems may also be used in a variety of other applications involving the heat-dissipation, reflection, as well as the cooling of other kinds of LED systems.

Therefore, an objective of the embodiments herein is to design LED modules and UV LED curing units that eliminate unnecessary electrical insulating layers, reflectors, and secondary optical lenses by integrating the optical, mechanical, and heat dissipation systems into an LED Module and by integrating unit enclosure into the heat dissipation design. This integration subsequently allows simplified manufacturing and the LED module to be replaceable. The said UV LED modules may be in any shape and size depending on the specific application, including multiple LED chips directly being mounted on metal heat sink and providing a single layer optical lens. The UV LED modules may include multiple groups of LED chips directly mounted on metal heat sink and the single layer optical lens for each group of the LED chips. The UV LED module may further include a lens holder to secure the said single layer optical lenses. A curing unit utilizing either of the UV LED modules will not need secondary lenses because the LED modules used are not universal packages, rather, they are already designed for the curing application. Depending on the curing applications, the output intensity and coverage can be optimized by adjusting the size of the arrays of LED modules, number of chips grouped under the same optical lens, and the shape of optical lens.

Another objective of the embodiments herein is to design LED curing unit, with one, or X array or XY arrays of extruded aluminum housings to house the above integrated UV LED modules. The said extruded aluminum housings also act as the heat sink and may have air circulation slots, and/or flutes, and/or fins to enhance heat dissipation from the LED chips. A unit cover with fans and air intakes holes may be used to enhance air circulation.

Another objective of the embodiments herein is to design LED curing unit, with one, or X array or XY arrays of the above integrated UV LED modules coupled on the face plate of a single piece metal extrusion that includes cooling channels, wiring channels and threads to receive fittings for the cooling agent on one end of the channels and to receive fittings to connect to next unit on the other ends. The other ends of the cooling channels may be inter-connected through hose or through a recess between the channels, together with a o-ring seal and an end cover.

Yet Another objective of the embodiments herein is to design LED curing unit, with one, or X array or XY arrays of the above integrated UV LED modules coupled on the face plate of a single piece metal extrusion that includes openings for blowing fans, and cooling channels, as well as wiring channels.

The described embodiments herein implement the integration of the optical, mechanical, and heat dissipation systems to the LED module by designing a UV LED module that integrates a single optical lens system for the final LED curing system into the LED module, as well as a heat dissipation system that allows the LED chips directly contacting the heat sink of the LED curing unit.

One configuration herein provides an enclosure with fans and air intake holes to cover XY arrays of curing modules. Each module includes a cylindrical housing and a UV LED module and other wiring accessories.

Another configuration herein describes an extrusion that integrates cooling channels, wiring channels, threads to receive fittings and face plate to receive XY arrays of UV LED modules. The general cooling channel design involves two parallel channels that pass through the unit, with each row of the UV LED modules in close proximity to a cooling channel to allow for maximum heat transfer. The cooling design allows for a similar average operating temperature for all connected units; this is important because it means that connected units will have a similar efficacy and operating lifetime. In addition, using two smaller diameter cooling channels, instead of one, provides more cooling contact surface area than that provided by a single channel taking up the same volume; this allows for a more compact unit design. The cooling channels may be interconnected. The unit size is scalable to accommodate a different number of LED modules. While using only one UV LED module is possible, the preferred design incorporates multiple modules staggered to provide optimal curing uniformity on object. In addition, covers, handles and other accessories may be used to retrofit the curing unit into an existing printing press.

Another configuration herein describes an extrusion that integrates blowing fans, cooling air channels and wiring channels and face plate to receive XY arrays of UV LED modules. The general cooling channel design involves fins on the back of the face plate to form additional channels for cooling air to pass through. The unit size is scalable to accommodate a different number of LED modules. While using only one UV LED module is possible, the preferred design incorporates multiple modules staggered to provide optimal curing uniformity on object. In addition, covers, handles and other accessories may be used to retrofit the said curing unit into an existing pressing printing press.

Figure 2A:
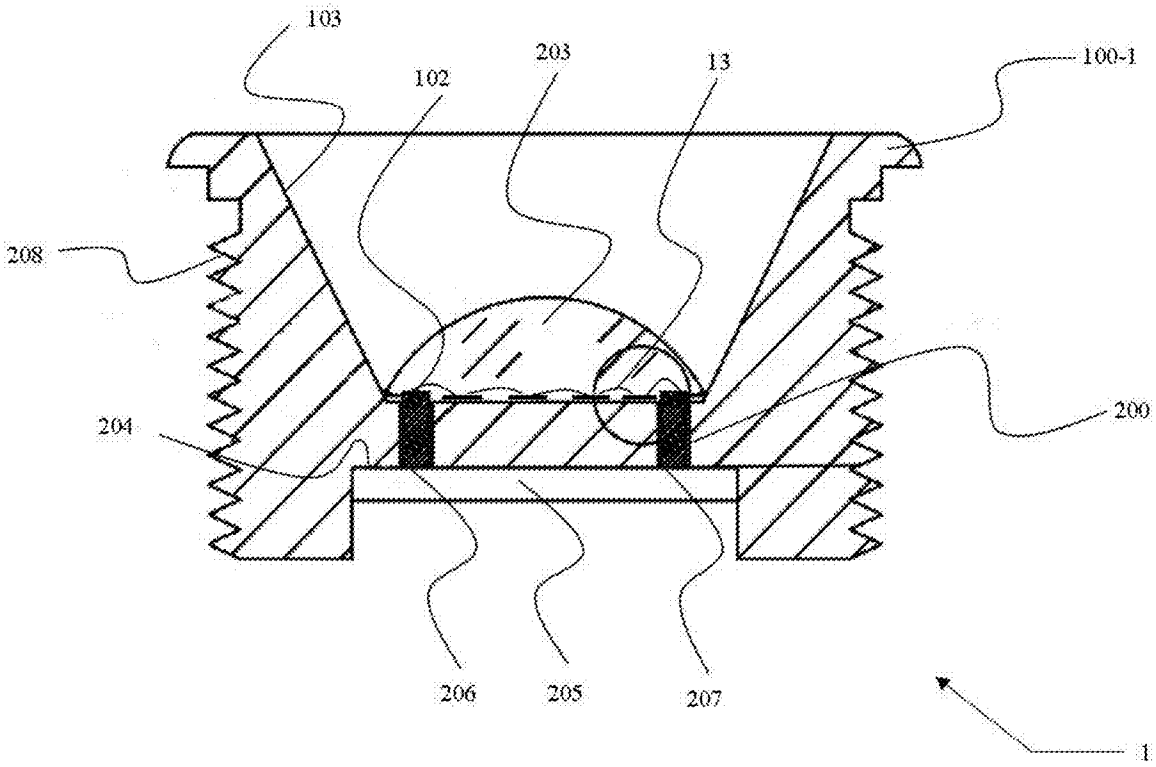
FIG. 2A shows an exemplary cross-section view of the LED module in FIG. 1.
Figure 2B:
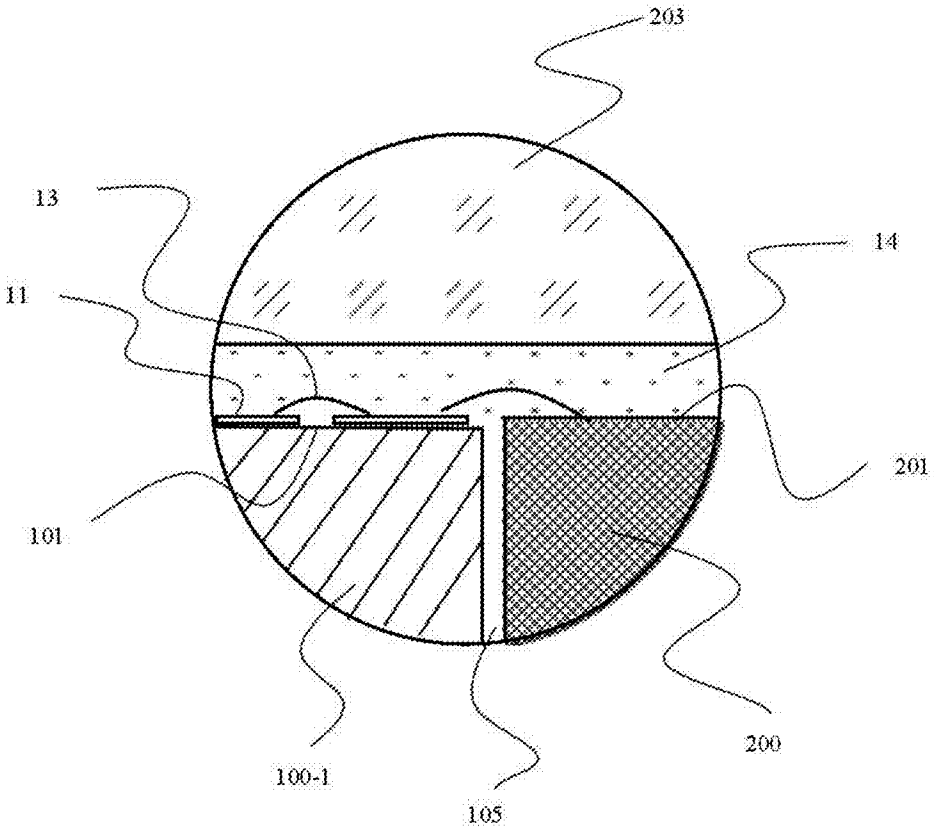
FIG. 2B shows a more detailed portion thereof.

FIG. 1 shows an exemplary top view layout of an UV LED module [1], including a plurality of LED chips [11], in one embodiment. FIG. 2A shows the cross section view and FIG. 2B shows a more detailed portion thereof. UV LED module [1] is depicted having seven LED chips [11] which are directly mounted on the flat surface [101] of the heat dissipation base [100-1]. Although illustrated having seven LED chips [11], it will be appreciated that more or fewer LED chips may be included without departing from the scope hereof. For example, UV LED module may have only a single LED chip [11]. The flat surface [101], in embodiments, is metal plated, preferably silver plated, to reflect light. The flat surface may also include other types of thermal conductive layers (e.g. Aluminum Nitride or Silicon) to electrically separate the LED chips. The concave surface [103] is also utilized to reflect light. The concave surface [103] may have textures. The concave surface [103] may also be untextured, thus purely conical. LED chips [11] are interconnected in series and/or in parallel by gold wires [13] and are then wire-bonded to surface [201] of the metal pins [200] (see FIG. 2B) which branch from the front side of the heat dissipation base [100] to the back side via holes [105]. The metal pins [200] are electrically isolated from heat dissipation base [100-1]. A glass lens [203] sits on the step [202] on the interior surface of the heat dissipation base [100-1]. Optical compound [14], preferably with the same refractive index as glass, fills the space beneath glass lens [203] and LED chips [11]. PCB [205] is attached to the flat circular surface [204] and has two contacting pads [206 and 207] for soldering the metal pins [200] to. There are optional threads [208] on the exterior of the heat dissipation base [100-1].

Figure 3:
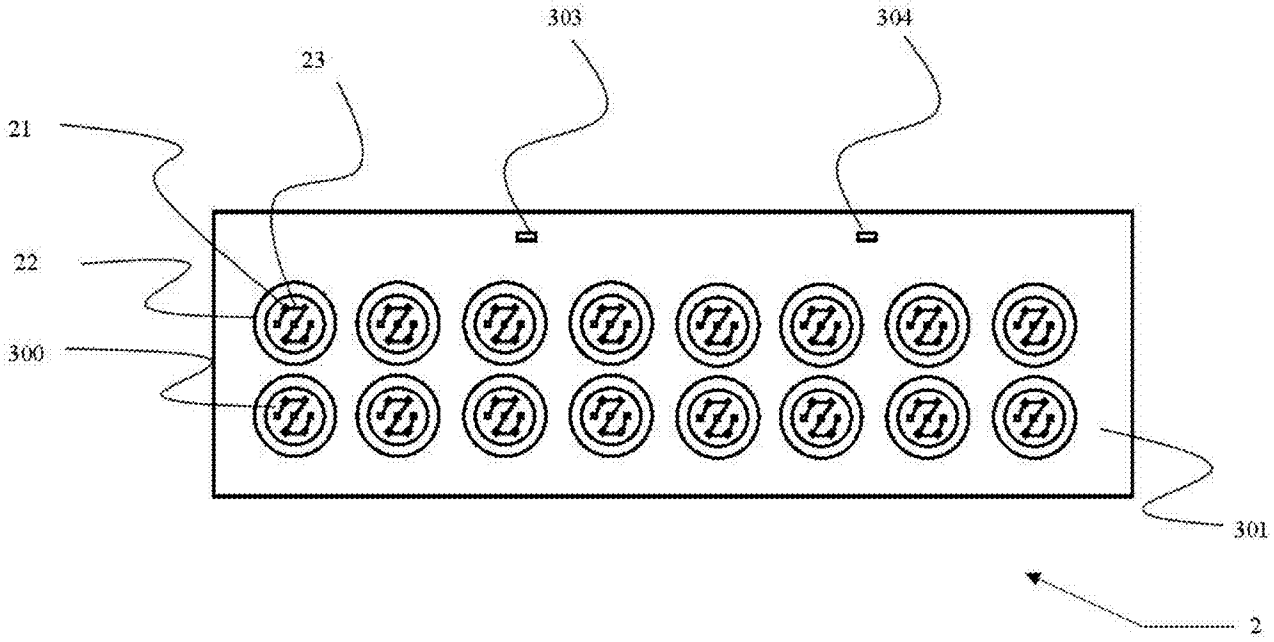
FIG. 3 is an exemplary top view layout of a rectangle shaped UV LED module, including a plurality of groups of LED chips, in another embodiment.
Figure 4:
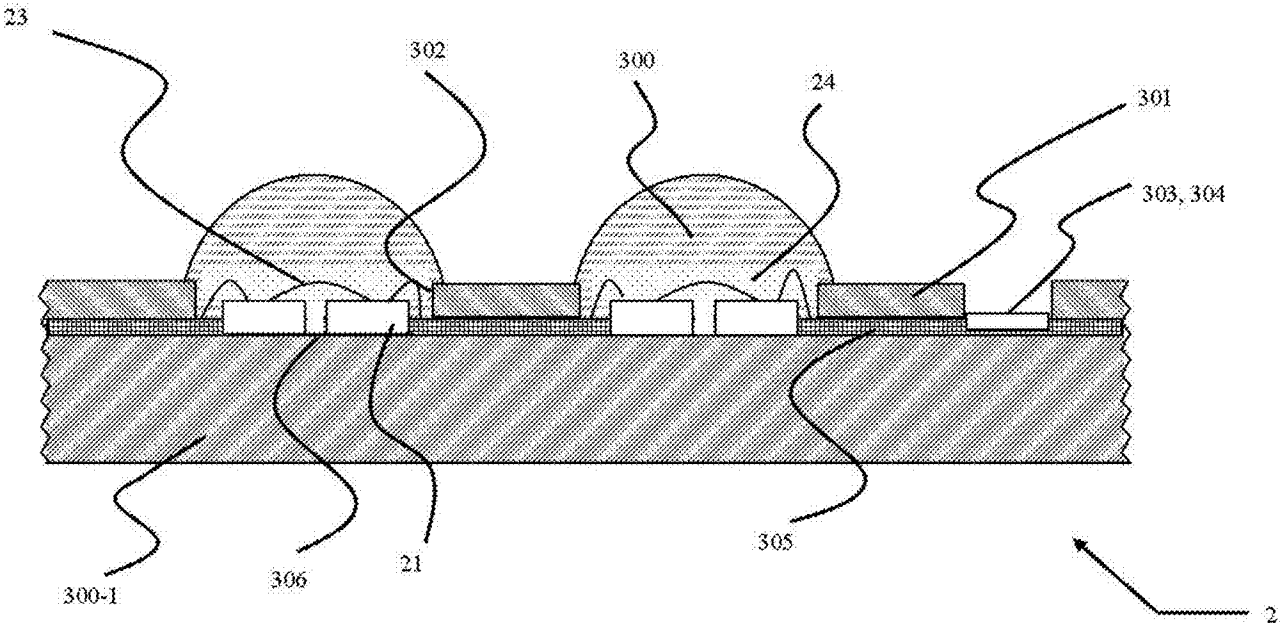
FIG. 4 shows a detailed portion of an exemplary cross-section view of the LED module in FIG. 3.

FIG. 3 shows an exemplary top view layout of an UV LED module [2], including a plurality of groups [22] of LED chips [21], in another embodiment. FIG. 4 shows the cross-section view and a more detailed portion thereof. UV LED module [2] is depicted having sixteen groups of seven LED chips [21] which are directly mounted on the flat surface [306] of the heat dissipation base [300-1]. Although illustrated having sixteen groups [22] of seven LED chips [21], it will be appreciated that more or fewer LED chips or groups may be included without departing from the scope hereof. Those groups can be arranged in any combination of an X array (a single row of modules, example not shown) or XY arrays (having multiple rows of modules, e.g., the embodiment of FIG. 3). The flat surface [306] may be metal plated, preferably silver plated, to reflect light. Although silver plating is used in the disclosed embodiments, other reflective metals and/or coatings could be used alternatively. Depending on the designed input voltage and current, each group [22] of the LED chips [21] are interconnected in series and/or in parallel by gold wires [23] and are then wire-bonded to the corresponding negative and positive metal contact pads on the PCB board [305]. The negative metal contact pads for all groups and the positive metal contact pads for all groups are electrically connected in series and/or in parallel and are finally connected to the negative and positive metal contact pads [303, 304]. The above electrically connection are directly designed on the PCB board [305]. FIG. 3 shows the preferred locations of the metal contact pads [303, 304]. A face cover[301] that has openings [302] to allow the flat surface [306] and the LED chips [21] to be mounted on top of the heat dissipation base [300-1]. A glass lens [300] sits on the edge of the openings [302] of the face cover [301]. The face cover can be made of any material such has metal and plastic. Optical compound [24] fills the space beneath glass lens [300] and LED chips [21].

Figure 5A:
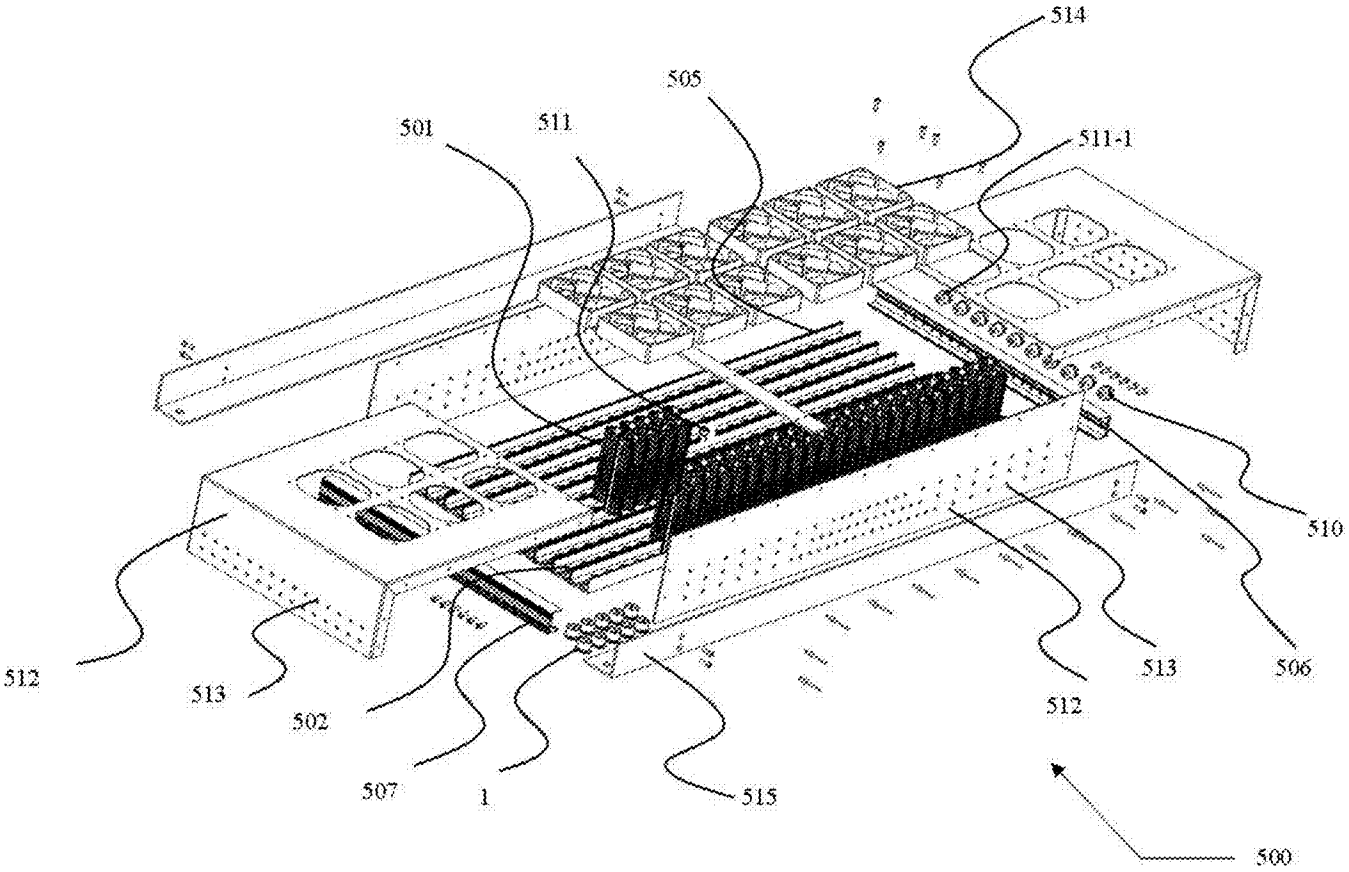
FIG. 5A is the exploded angle view of an exemplary LED curing unit with XY arrays of extruded housings.

FIG. 5A illustrates an embodiment of an UV LED curing unit [500] utilizing XY arrays of heat-dissipating cylindrical extruded housings [501] arranged on one side of rows of extruded "U"-channels [505]. The "U"-channel [505] has holes [502] to allow the PCB assemblies [508] to come through from the other side, and to allow the UV LED modules [1] to come through from the other side and be threaded into the cylindrical housings [501] to contact the PCB assemblies [508]. Rows of "U"-channel members [505] are then received into and secured into channel holders [506] and [507].

Figure 5B:
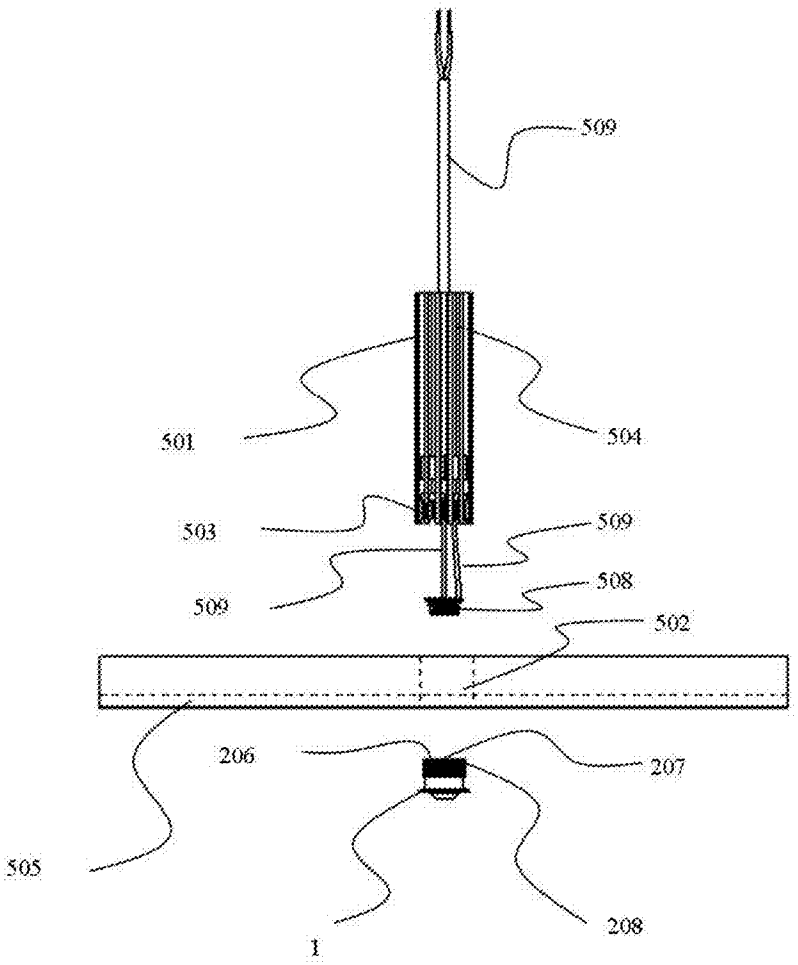
FIG. 5B shows the details of one of the extruded housings and the LED module it receives.

The PCB assembly [508] has a first side including two contact elements for making contact with the pads [401 and 402] from the LED module [1] and a second side including wires [509] soldered to it for connecting to the power connectors [510] located on one of the—channel holder [506]. FIG. 5B shows the details of one of the extruded housings and the LED module it receives. It can be seen that the external threads [106] on the LED module [1] complement internal threads [503] of a cylindrical housing [501]. Cylindrical housing [501] is fluted [504], extruded metal, preferably aluminum, to increase the heat sink's radiation. A temperature sensor [511] may be integrated in the center of the XY arrays. The temperature sensor [511] is wired to power connector [511-1] that is also located on the channel holder [506] for the purpose of shutting off the unit to prevent the overheating of the LED chips so that degradation does not occur. One of a pair of opposing unit side walls

[512] has optional air intake holes [513] and optional fans [514], and the brackets [515] cover the top and sides of extruded housing [501], "U"-channels [505] and channel holders [506,507].

Figure 6:
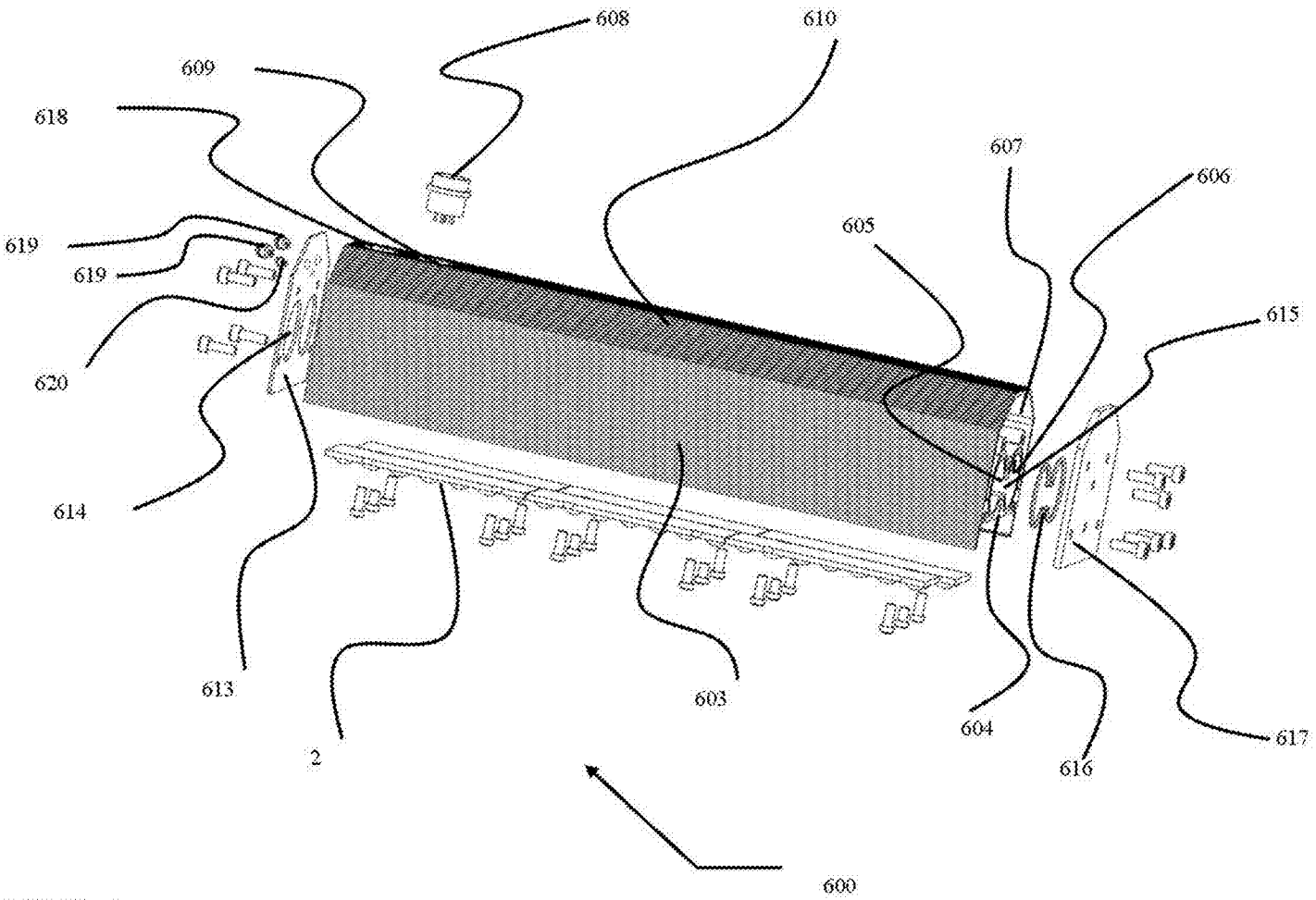
FIG. 6 is the exploded angle view of another exemplary LED curing unit with XY arrays of UV LED modules.
Figure 7B:
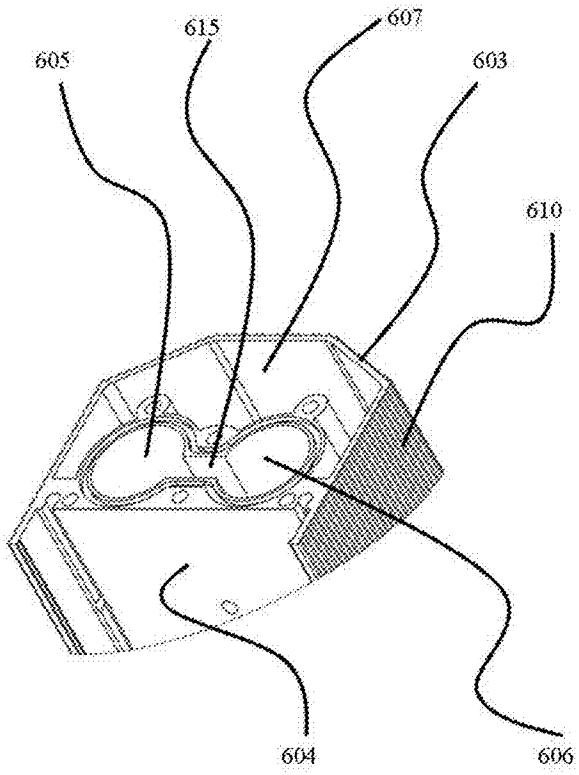
FIGS. 7A and 7B is two views of the connection end of the housing that accompany FIG. 6. The cut in the housing allows for a recessed connection between the channels.
Figure 7A:
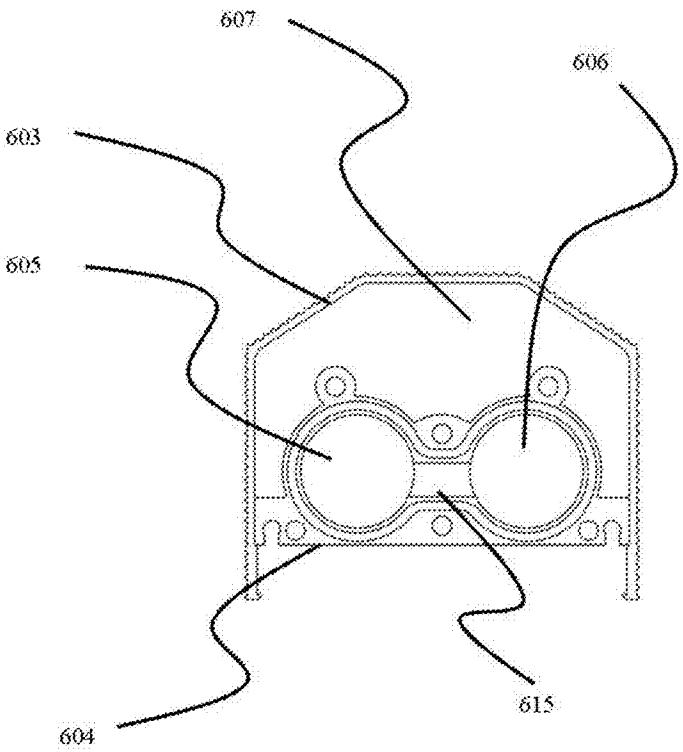
Figure 8:
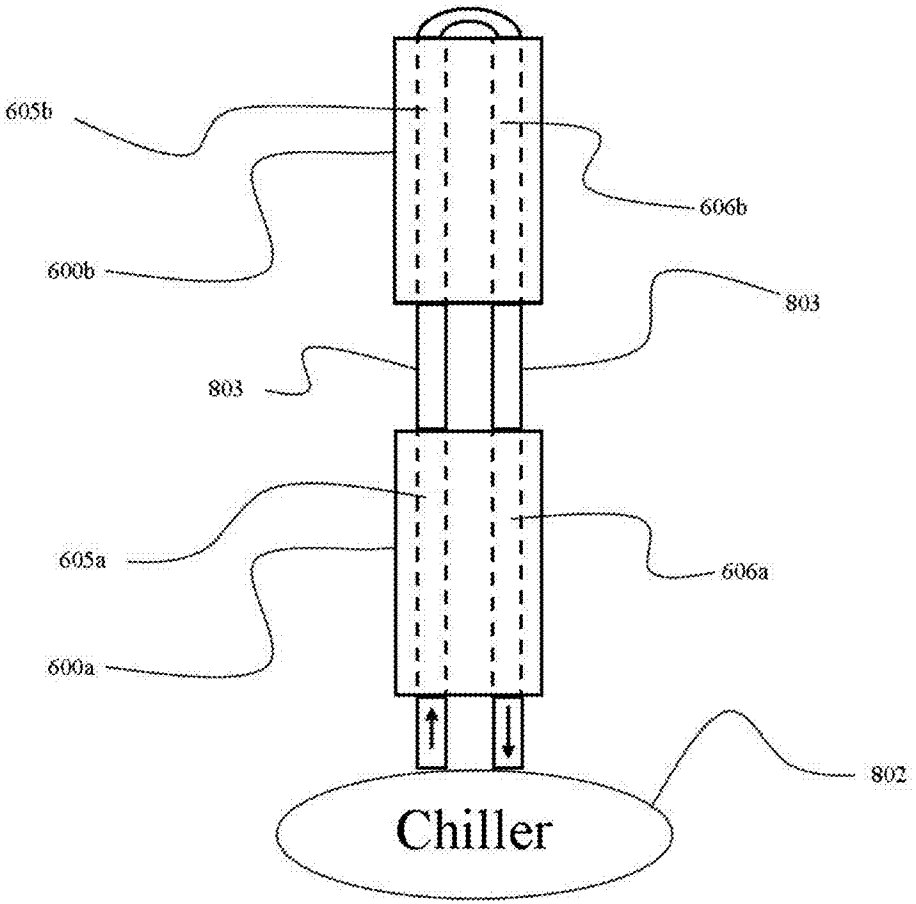
FIG. 8 is exemplary arrangements of multiple LED curing units that allow each curing unit to maintain similar average temperature.

FIG. 6 illustrates another example of an UV LED curing unit [600]. FIG. 7A and FIG. 7B disclose two views of the interconnected end of the extrusion that accompanies FIG. 6. The curing unit [600] utilizes an enclosing metal extrusion [603], preferably aluminum, which creates a longitudinal chamber behind a heat conductive face plate [604] which will serve as a mounting surface for the XY arrays of UV LED modules [2], cooling channels [605, 606] to accommodate air or liquid that acts as a coolant, a longitudinally extending space [607] created for running wires for making electrical connections. Although heat conducting plate [604] is shown in the drawings as being planar, it should be recognized that the use of the term "plate" as used herein does not require that it be flat. Thus, "plate" should be given an interpretation requiring only that it be capable of mounting LEDs as shown. The said air may be compressed air, the said liquid may be drawn from a chiller. Alternatively, liquid coolant could be used. Temperature sensors [608] are installed on the extrusion [603] through the hole [609] and wired to the power connector [620] for the purpose of shutting off the unit to prevent the overheating of the LED chips so that degradation does not occur. The metal extrusion [603] includes flutes [610] to maximize heat transfer. Two ends of the said cooling channels contain threads to receive liquid or air hose fittings. The end cover [613] with holes [614] covers the wiring channel [607] and leaves the cooling channels open. The other ends of the said cooling channels [605,606] may contain threads to receive liquid and air hose fittings to form cooling circuits for multiple units as illustrated in FIG. 8. The other ends of the said cooling channels [605,606] may have a recess [615] to interconnect cooling channels [605] and [606], together with the o-ring seal [616] and the end cover [617], it forms a cooling circuit for the curing unit [600].

Electrical wires for the UV LED modules [2] come through the hole [618] to the power connectors [619]. Electrical wires for the temperature sensor [608] come through hole [609] to the power connector [620]. The said metal extrusion [603] may be an extrusion without the cooling channels. Such a metal extrusion may be coupled to one or more heat pipes to dissipate heat.

FIG. 8 illustrates the cooling circuit for two connected curing units, 600*a* and 600*b*, which are capable of being coupled together as part of an installation. All ends of the cooling channels are with threads to receive fittings. Cooling fluid from chiller [802] warms as it passes through tubing [803], the cooling channel [605*a*] of the unit [600*a*], the cooling channel [605*b*] of the unit [600*b*], and then into the cooling channel [606*b*] of unit [600*b*] and into the cooling channel [606*a*] of the unit [600*a*]. With arrangement like the one shown in FIG. 8, the average temperature of two units, when in operation, will be similar. Although two units were illustrated in FIG. 8, it is possible to couple numerous units (e.g., unit 600) together, and still maintain similar average temperature on all units.

In other words, the longitudinally extending first cooling conduit [605], in the case the unit is the only unit used, or is the last in the chain, will utilize the effective cap 617 as well as the recess 615 to complete the return into the second conduit 606. Thus a first end a coupler of the end on the left is coupled to the heat transfer medium source, and the second end is of that same conduit creates a return passageway to return the heat transfer medium to the source.

In other instances, where the unit is connected to an adjacently-connected lamp housing (see FIG. 8), both conduit ends (on the right hand side of FIG. 6) are configured to be coupled to corresponding conduits in the adjacently-connected lamp housing. Thus, the units are completely modular, and the number of units can be increased to make for a longer illumination area.

Figure 9:
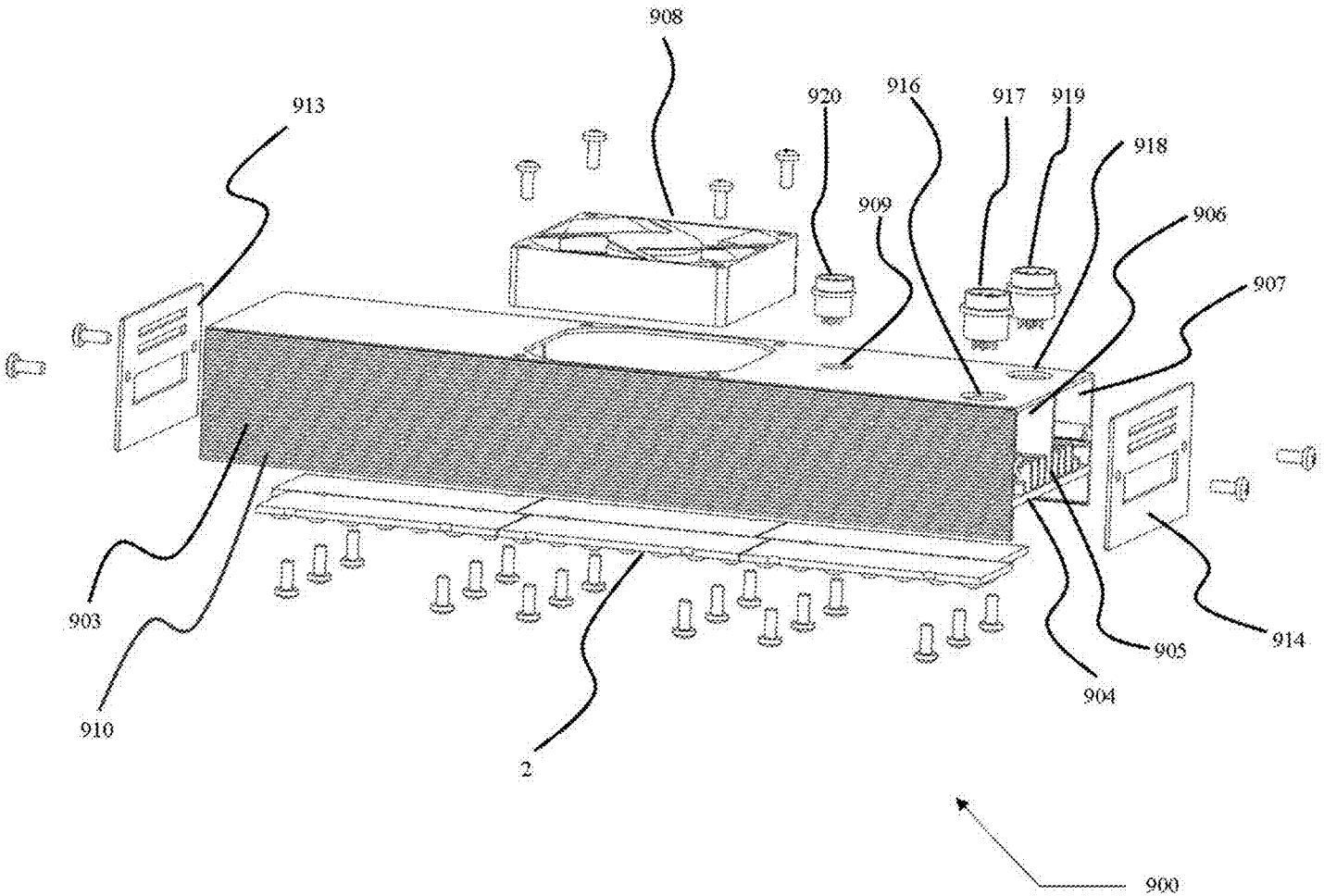
FIG. 9 is the exploded angle view of yet another exemplary LED curing unit with XY arrays of UV LED modules.

FIG. 9 illustrates yet another example of an UV LED curing unit [900]. The curing unit [900] utilizes a metal extrusion [903], preferably aluminum, with a face plate [904] to receive XY arrays of UV LED modules [2], cooling fins [905] forms multiple cooling channels to allow air pass through, wiring channels [906,907] for running wires for electrical connections. Temperature sensors are installed on the extrusion [903] and wired to the power connector [920] through the holes [909] for the purpose of shutting off the unit to prevent the overheating of the LED chips so that degradation does not occur. The metal extrusion [903] includes flutes [910] to maximize heat transfer. Blowing fan [908] is installed on the extrusion [903] to provide air flow. The end covers [913, 914] have slots for air flow. Electrical wires for the UV LED modules [2] come through the hole [916, 918] to the power connectors [917, 919].

The invention claimed is:

1. A lamp housing comprising:
   - a housing including a plurality of LEDs externally mounted along a longitudinally extending heat conductive plate;
   - a longitudinal chamber defined behind the plate; and
   - a longitudinally extending first cooling passageway running along and behind an internal side of the plate, the first passageway having at a first end intaking a heat transfer medium from a heat transfer medium source, the first passageway having a discharge end, the discharge end being configured to be one of: (i) connected into a heat transfer conduit in an adjacently-connected lamp housing, (ii) configured to create a return passageway for the heat transfer medium to the source, or (iii) vents to a space outside the housing.

2. The lamp housing of claim 1 comprising:
   - a second longitudinally extending return passageway running along and behind the plate, the return passageway having a receiving end that is configured to be coupled to a similar return passageway in the adjacently-connected lamp housing, and the return passageway having a second end that is configured to return the heat transfer medium to the source.

3. The lamp housing of claim 1 wherein the plurality of LEDs emit in ultraviolet, and the heat transfer medium is one of air and a liquid.

4. The lamp housing of claim 2 wherein a substantially enclosed longitudinal space is created in the chamber, the longitudinal space enabling wires to be run to the LED modules.

5. The lamp housing of claim 1 wherein the first passageway is a receiving conduit which receives the medium, and a second conduit which also transmits the medium is oriented substantially in parallel with the first conduit along the inner side of the plate.

6. The lamp housing of claim 1 wherein a the medium is driven through the passageway using a fan.

7. The lamp housing of claim 1 comprising:
   - a hood portion which, along with the plate, defines the longitudinal chamber behind the plate, both the hood and the plate being part of a common, integral, longitudinal extrusion.

* * * * *